United States Patent [19]

Pipaud

[11] 4,315,567

[45] Feb. 16, 1982

[54] APPARATUS AND METHOD FOR SELECTING FROM COINS OR TOKENS

[75] Inventor: Lucien M. A. Pipaud, St Nicolas de Redon, France

[73] Assignee: Societe de Recherches et de Perfectionnements Industriels et Etablissements H. Morin-Secretan, Cachan, France

[21] Appl. No.: 165,047

[22] Filed: Jul. 1, 1980

[30] Foreign Application Priority Data

Jul. 13, 1979 [FR] France ..... 79 18225

[51] Int. Cl.[3] ..... G07F 3/02

[52] U.S. Cl. ..... 194/101; 194/97 R; 133/3 R

[58] Field of Search ..... 194/97 R, 100, 101; 133/3 R

[56] References Cited

U.S. PATENT DOCUMENTS 1,838,907 12/1931 Du Grenier ..... 194/101
2,298,440 10/1942 Vieth ..... 194/101
3,556,276 1/1971 Pennell ..... 194/101
3,672,481 6/1972 Hastie et al. ..... 194/101

FOREIGN PATENT DOCUMENTS 92304 7/1920 Switzerland ..... 194/101

*Primary Examiner*—Joseph J. Rolla
*Attorney, Agent, or Firm*—Pearne, Gordon, Sessions, McCoy & Granger

[57] ABSTRACT

In apparatus for rejecting from coins or tokens those whose magnetic characteristic exceeds a prescribed threshold, said apparatus comprising a path for the coins having an opening in which a first magnet engages when a magnetic coin passes along the path opposite the opening and, upstream of the first magnet, a second magnet, the improvement that the magnets are carried by an integral mounting and are separate pole pieces and the second magnet is shaped or positioned so that the magnetic force passing in front of it along the path is less than that with which the first magnet is attracted by this same coin when it passes in front of the opening.

6 Claims, 3 Drawing Figures

APPARATUS AND METHOD FOR SELECTING FROM COINS OR TOKENS

Figure 2:
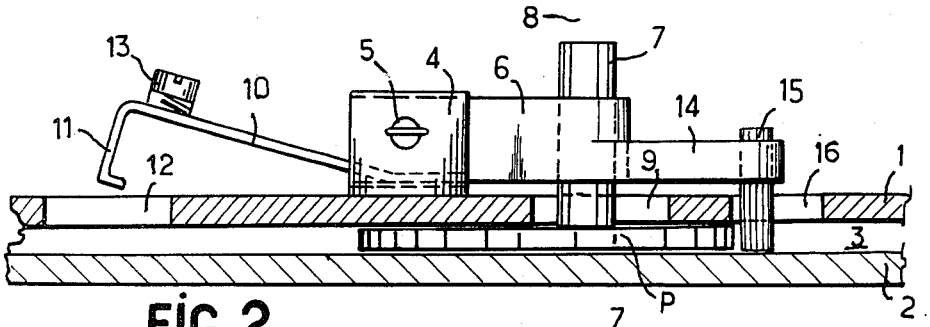

The invention relates to apparatus for selecting from coins or tokens capable of rolling those which have a prescribed characteristic and which are used in automatic telephone booths and in automatic vending machines.

In German Pat. No. 602,908 apparatus for this purpose is described which comprises two magnets M and E which are not integral with one another and one of which, M, is fixed, said apparatus being of the type in which a coin has a choice between two paths. If it is not magnetic, it is not attracted by the magnet M and it falls through a window A. If it is magnetic in a correct way, it is attracted by the magnet M and it continues along its path. If it is too magnetic, when it continues along its path, it attracts the magnet E. However, a highly magnetic coin may not be retained by the magnet E if said coin passes sufficiently rapidly. A non-magnetic coin may, if it is inserted with skill, pass across the window opposite the fixed magnet M and play the part of a correct magnetic coin.

The invention overcomes these disadvantages by means of a device having a very high degree of safety which, in particular prevents any coin which is too magnetised from playing the part of a correct coin.

The object of the invention is therefore apparatus for rejecting from coins or tokens those whose magnetic characteristic exceeds a prescribed threshold, said apparatus comprising a path for the coins having an opening in which a first magnet engages when a magnetic coin passes along the path opposite the opening and, upstream of the first magnet, a second magnet, characterised in that the second magnet is integral with the first and is shaped or positioned so that the magnetic force with which it is attracted by a magnetic coin passing in front of it along the path is less than that with which the first magnet is attracted by this same coin when it passes in front of the opening.

When a magnetic coin pases along the path, it attracts the second magnet, thereby setting the first in motion. When it passes in front of the first magnet, it is attracted, if it is magnetic, in a reliable manner, since any delay due to mechanical inertia is avoided owing to the previous setting in motion of the first magnet by the second. A coin which is too magnetic, even though it is sent along at high speed, remains stuck to the first magnet.

When an obstacle blocks normally the path downstream of the first magnet and withdraws temporarily out of the path only in response to the detection by the first magnet of a coin having a magnetic characteristic above a given value, the functioning is very reliable, not only because, with the path being closed positively, the passage of any abnormal coin is prevented, but, above all, because the opening of the passage caused by a correct coin is very reliable, since the inertia of the first magnet is overcome without fail. Experience shows that no correct coin is refused, whereas, before, in apparatus of the same type one correct coin out of 80 was refused. The magnetic force applied to the magnet forming the device is larger than that applied to the magnet forming the obstacle upstream, since the first magnet has a larger extent than the second and/or since the pole of the first magnet which is nearest the rolling path is nearer the rolling path than the corresponding pole of the second magnet.

Figure 1:
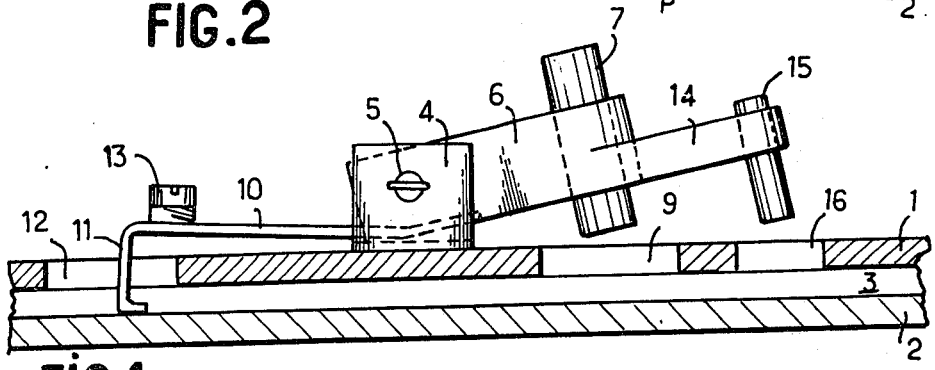
Figure 3:
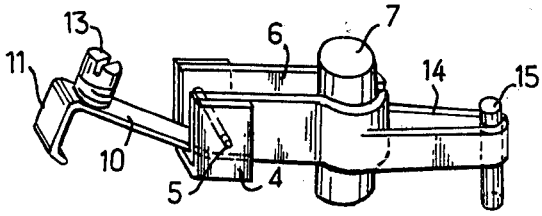

In the attached drawing given purely by way of example:

FIGS. 1 and 2 are plan views of apparatus according to the invention and FIG. 3 is a partial view in perspective.

The apparatus of FIGS. 1 to 3 is composed of two parallel vertical flanges 1, 2 spaced one from the other at a distance just exceeding the thickness of the coins having the prescribed characteristic. The lower edges of the flanges 1 and 2 are inclined downwardly from right to left in FIG. 1 and are connected by a base so as to define a rolling path 3 for the coins P.

Fixed to the outer face of the flange 1 is a joint piece 4 whose pivot 5 is parallel to the flange 1 and is perpendicular to the direction followed by the coins P along the rolling path 3. Two jaws 6 are integral with the pivot 5 and grip of cylindrical permanent magnet 7. The axis 8 of the magnet 7 coincides with an opening 9 made in the flange 1 upstream of the joint piece 4.

The pivot 5 is integral with a locking catch 10 whose bent and pointed nose 11 stands opposite an opening 12 made in the flange 1 downstream of the joint piece 4.

Before the bend of the catch 10 a counterweight 13 is fixed to the catch.

Welded to each jaw 6 is an arm 14 of a holder gripping a magnet 15 of smaller size than the magnet 7 and having an axis parallel to that of the magnet 7, said magnet 15 entering the rolling path 3 by passing through an opening 16 made in the flange 1 upstream of the opening 9.

As shown in FIG. 1, in the absence of a magnetic coin P in front of the opening 9 and therefore in the absence of magnetic forces of attraction of the magnet 7, the counterweight 13 applies a sufficiently large moment in relation to the magnets 7 and 15 for the nose 11 to pass through the opening 12 and block the rolling path 3 by constituting an obstacle to the passage of coins both in one direction and in the other. However, when (FIG. 2) a coin P having the prescribed characteristic, namely the property of being magnetic, passes in front of the opening 16, it begins to set in motion the magnet 15 and therefore also the magnet 7, so that, when the coin P arrives in front of the opening 9, it attracts the magnet 7 in a reliable manner. The jaws 6 swing and cause the pivot 5 to turn. The catch 10 pivots in a clockwise direction and the nose 11 withdraws from the rolling path 3 through the opening 12, thus giving way to the coin P.

As soon as a coin P having the prescribed characteristic has passed in front of the opening 12, the counterweight 13 brings the nose 11 back into the rolling path 3.

However, if a coin P which is too magnetic remains stuck to the magnet 7, the obstacle 15 remains in the rolling path 3 upstream of the stuck coin P and prohibits any arrival of a new coin capable of releasing the coin P.

What I claim is:

1. In apparatus for rejecting from coins or tokens those whose magnetic characteristic exceeds a prescribed threshold, said apparatus comprising a path for the coins having an opening in which a first magnet engages when a magnetic coin passes along the path opposite the opening and, upstream of the first magnet, a second magnet, the improvement that the magnets are carried by an integral mounting means and are separate pole pieces and the second magnet is shaped or positioned so that the magnetic force with which it is attracted by a magnetic coin passing in front of it along the path is less than that with which the first magnet is attracted by this same coin when it passes in front of the opening.

2. The apparatus of claim 1, wherein when neither of the two magnets is attracted by a magnetic coin, the second magnet is further removed from the path than is the first magnet.

3. The apparatus of claim 1, wherein the first magnet has a larger extent than the second.

4. The apparatus of claim 1, making it possible to select from coins those whose magnetic characteristic is above a given value, wherein an obstacle normally blocks the path downstream of the first magnet and withdraws temporarily out of the path only in response to the detection by the first magnet of a coin having a magnetic characteristic above a given value.

5. The apparatus of claim 1, wherein an opening is made in the path opposite the second magnet and the course of this second magnet is such that it can engage in said opening until it blocks the path.

6. The apparatus of claim 5, wherein the second magnet blocks the path when a coin having a magnetic characteristic exceeding the prescribed threshold is situated opposite the opening in which the first magnet is engaged by which the coin is retained.

* * * * *